US011333357B2

(12) United States Patent
Carlson et al.

(10) Patent No.: US 11,333,357 B2
(45) Date of Patent: May 17, 2022

(54) MULTIPLE SPARK AND MULTIPLE SENSE IGNITER ASSEMBLY AND SYSTEM

(71) Applicants: Brent Carlson, Watertown, WI (US); Simon Walker, Mooresville, NC (US); Doug Westrich, Sussex, WI (US)

(72) Inventors: Brent Carlson, Watertown, WI (US); Simon Walker, Mooresville, NC (US); Doug Westrich, Sussex, WI (US)

(73) Assignees: Baso Gas Products, LLC, Watertown, WI (US); Flynn Burner Corporation, Mooresville, NC (US)

( * ) Notice: Subject to any disclaimer, the term of this patent is extended or adjusted under 35 U.S.C. 154(b) by 450 days.

(21) Appl. No.: 16/598,023

(22) Filed: Oct. 10, 2019

(65) Prior Publication Data

US 2020/0116358 A1 Apr. 16, 2020

Related U.S. Application Data

(60) Provisional application No. 62/743,954, filed on Oct. 10, 2018.

(51) Int. Cl.
*F23N 5/10* (2006.01)
*F23N 5/02* (2006.01)

(52) U.S. Cl.
CPC ..... *F23N 5/105* (2013.01); *F23N 5/025* (2013.01); *F23N 2229/02* (2020.01); *F23N 2229/14* (2020.01)

(58) Field of Classification Search
None
See application file for complete search history.

(56) References Cited

U.S. PATENT DOCUMENTS

| | | | |
|---|---|---|---|
| 3,390,943 | A | 7/1968 | Myers |
| 3,909,816 | A | 9/1975 | Teeters |
| 4,207,053 | A | 6/1980 | Turner et al. |
| 4,370,557 | A | 1/1983 | Axmark et al. |
| 4,847,783 | A | 7/1989 | Grace et al. |
| 5,020,988 | A | 6/1991 | Peterson |
| 5,435,717 | A | 7/1995 | Bohan et al. |
| 5,807,098 | A | 9/1998 | Deng |
| 7,766,006 | B1 | 8/2010 | Manning |
| 8,057,219 | B1 | 11/2011 | Manning et al. |
| 8,985,094 | B2 | 3/2015 | Deng |

*Primary Examiner* — Jason Lau
(74) *Attorney, Agent, or Firm* — Joseph S. Heino; Erin E. Kaprelian

(57) ABSTRACT

An apparatus may comprise a first carrier tube having a first input end and a first output end and a second carrier tube disposed substantially parallel to the first carrier tube and having a second input end and a second output end. A cross tube may be coupled to the first carrier tube and the second carrier tube and may be disposed substantially perpendicularly between the carrier tubes. A plurality of burner holes may be disposed along the first carrier tube, the second carrier tube, and the cross tube. A plurality of flame sensors may be disposed at various locations of the first carrier tube and the second carrier tube. A first igniter assembly may further be coupled to the first carrier tube.

7 Claims, 1 Drawing Sheet

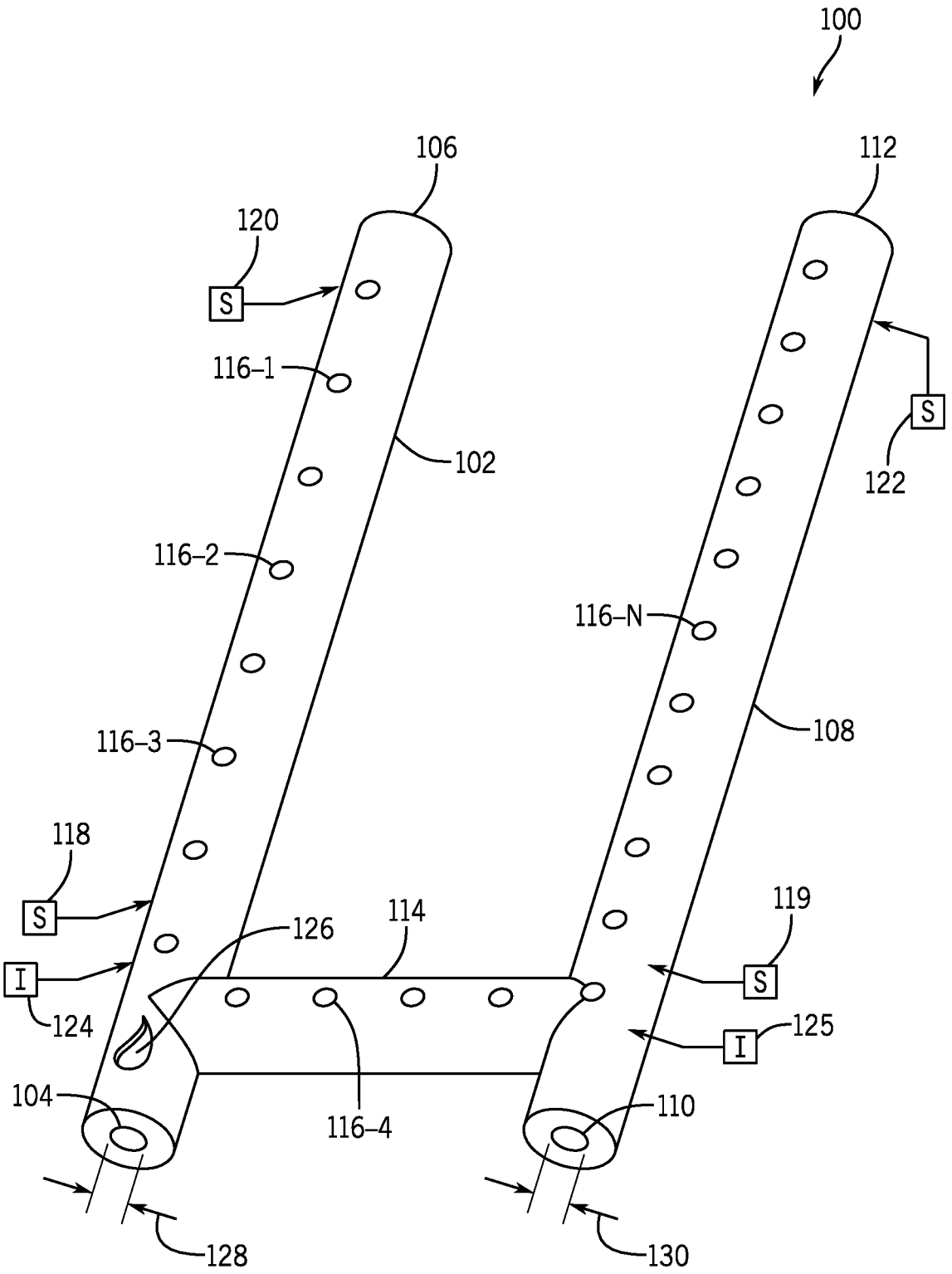
100
106
112
120
S
116–1
102
S
122
116–2
116–N
108
116–3
118
S
119
126
114
S
I
124
I
125
104
116–4
110
128
130

MULTIPLE SPARK AND MULTIPLE SENSE IGNITER ASSEMBLY AND SYSTEM

PRIORITY

This application claims priority to U.S. Provisional Application No. 62/743,954, filed Oct. 10, 2018, the contents of which are hereby incorporated by reference.

BACKGROUND

Many gas-fueled devices use a pilot light to ignite a main gas burner. Typical applications include commercial cooking equipment, heaters, kilns, dishwashing equipment, industrial ovens, and similar applications. In a situation where the pilot flame becomes extinguished, for any reason, there is the potential for un-combusted gas to be released into the surrounding area, thereby creating a serious risk of uncontrolled combustion, explosion and fire. To prevent such a dangerous condition, gas supply valves of the present invention use a thermocouple or sensor to detect when the pilot flame is burning.

BRIEF DESCRIPTION OF THE DRAWINGS

FIG. 1 is an example apparatus consistent with the present disclosure.

DETAILED DESCRIPTION

Gas-fueled devices, such as furnaces and oven, work by heating, and thus igniting, flowing gas by means of an ignition source, such as a pilot flame. So long as the flame remains ignited, any gas released into the system will combust. However, the flame may become accidentally extinguished. When a flame is extinguished, gas may continue to flow; however, it does not combust but builds up. Continued buildup of this un-combusted gas presents a serious risk of explosion, fire, or even death due to an accidental combustion.

In order to sense when a flame is extinguished, and thus when gas may be leaking into a system, sensors may be used in the system to safely close a supply valve, stopping any further un-combusted gas from leaking into the system. One type of sensor uses a thermocouple. As used herein, a thermocouple refers to the coupling, or joining, of two dissimilar metals to create a voltage potential between them. A thermocouple works when heat is maintained; that is, the voltage potential remains so long as heat, such as from a flame, is across the thermocouple. If the heat is not maintained, the voltage potential across the thermocouple is not maintained, resulting in the opening of the electrical circuit created by the thermocouple. While a thermocouple can be used for a variety of purposes within a system, its primary function is to control a gas supply valve. The word "thermocouple" and the term "heat sensor" or just the word "sensor" will be used interchangeably throughout this disclosure and are considered the same for functional and structural purposes in relation to this disclosure.

To control a gas supply valve, a tip of the thermocouple is placed in the pilot flame. The resultant voltage, though small (typically greater than 10 mV), operates the gas supply valve responsible for feeding the pilot by keeping the gas supply valve open. as long as the pilot flame remains lit, the thermocouple remains hot and the pilot gas valve is held open. However, if the pilot flame goes out, the temperature of the surrounding air will fall. In addition, a corresponding drop in voltage across the thermocouple leads occurs, removing power from the valve. As a result of this loss of power, the valve closes and shuts off the gas, thereby halting the flow of gas by putting the valve in a "closed" position. The closure of the valve results in the prevention of un-combusted gas being leaked into the surrounding area, which would necessarily create a risk of uncontrolled combustion, fire, and/or explosion.

In some environments, such as industrial kitchens, multiple gas-fueled devices are present, with each device having its own sensor. This can prove cumbersome in the event of a problem with one of the devices, since each sensor may need to be checked. In addition, each device may require its own sensor despite being connected to the same gas line.

By contrast, the igniter assembly of the present disclosure provides a multiple spark/multiple sense capability. A multiple spark/multiple sense igniter assembly can be set up to have only one sensor active or multiple sensors active. To achieve the desired sense inputs, the igniter assembly needs to be electrically connected to the external (remote or dual rod) flame sense inputs. The igniter assembly may be electrically connected in a first way to have one sense line active and/or in other ways to have multiple sense lines active. Depending on the application, multiple sensors may be used to sense flame, or the absent of flame in a situation where the gas flow valve is in its "open" position.

The igniter assembly can also be configured to run using only a first external sensor which allows the first sensor to satisfy both sense circuit inputs, which allows the igniter assembly to function properly. Further, the igniter assembly can also be configured to run using only a second sensor. Running the igniter assembly using the second external sensor requires an electrical connection between the two sensor rod terminals on the module using an external electrical connection. This will allow the second external sensor to satisfy both sense circuit inputs, allowing the igniter assembly to function properly and thereby allowing functional operation of the gas flow valve.

In another mode, the igniter assembly can be configured to run using two external sensors which are not electrically connected to each other. In this case, each sensing circuit and sensor will be independently satisfied by the respective sensors. This setup is also valid for external sense lines. However, when using only one spark rod, one of the sense lines can be an internal sense line.

FIG. 1 is an example apparatus 100 consistent with the present disclosure. Apparatus 100 consists of a first carrier tube 102, a second carrier tube 108, and a cross tube 114. The first carrier tube 102 includes a first input end 104 and a first output end 106, and the second carrier tube 108 includes a second input end 110 and a second output end 112. As shown in FIG. 1, first carrier tube 102 and second carrier tube 108 are disposed substantially parallel to one another.

Cross tube 114 is disposed between first carrier tube 102 and second carrier tube 108 such that cross tube 114 is substantially perpendicular to both first carrier tube 102 and second carrier tube 108. However, examples are not so limited and cross tube 114 may be disposed at any configuration with respect to the first carrier tube 102 and second carrier tube 108. Cross tube 114 is coupled such that gas from a source (not shown in FIG. 1) is able to flow freely throughout apparatus 100. Said differently, cross tube 114 is hollow, as are first carrier tube 102 and second carrier tube 108, and is coupled to the carrier tubes 102, 108 by, for example, a cutout within the tube. First carrier tube 102, second carrier tube 108, and cross tube 114 may be made of any suitable material, such as steel, iron, or another metal, although examples are not so limited.

A plurality of burner openings 116-1, 116-2, 116-3, 116-4 . . . 116-N (collectively, burner openings 116) are disposed along the first carrier tube 102, the second carrier tube 108, and the cross tube 114. Burner openings 116 provide an outlet for gas and flame to flow up to the gas-burning device. Said differently, when gas is flowing through apparatus 100, it is able to escape and flow through burner openings 116.

Apparatus 100 may be coupled to a gas source (not shown in FIG. 1) by means of a first connector 128, located at the first input end 104, and a second connector 130, located at the second input end 110. First connector 128 and second connector 130 may comprise a thermocouple or other flame sensing system. and may operate to keep a gas supply valve contained within the connector open, as previously described. Thus, so long as apparatus 126 is ignited and apparatus 100 is connected to a gas source by connectors 128 and 130, gas should be flowing through the system.

Apparatus 100 may further comprise a first flame sensor 118. As used herein, a flame sensor refers to a subsystem that monitors the status of a pilot flame in conjunction with an igniter assembly (discussed further herein) to determine that a system is in a proper state for operation. First flame sensor 118 may include a thermocouple or other flame sensing system used to detect changes in temperature caused by, for example, extinguishment of a pilot flame. First flame sensor 118 may be disposed at the first input end 104 of the first carrier tube 102.

A second flame sensor 120 may be disposed at the first output end 106 of the first carrier tube 102. Similar to first flame sensor 118, second flame sensor 120 may include a thermocouple or other flame sensing system to detect temperature changes. However, due to its location, second flame sensor 120 may detect a temperature change earlier than first flame sensor 118. This is because, when a flame goes out, the temperature change will be detected sooner the further away from the source a sensor is. Second flame sensor 120 may be coupled to a first igniter assembly 124, discussed further herein. In some examples, first flame sensor 118 and second flame sensor 120 may be selectively in contact with one another A third flame sensor 122 may be disposed at the second output end 112 of second carrier tube 108. Third flame sensor 122 may be similar to first flame sensor 118 and second flame sensor 120 in that it may include a thermocouple or other flame sensing system to detect changes in temperature within second carrier tube 108. Third flame sensor 122 may be coupled to first igniter assembly 124 or may be coupled to second igniter assembly 125.

A fourth flame sensor 119 may be disposed at the second input end 110 of second carrier tube 108. As with first flame sensor 118, fourth flame sensor 119 may include a thermocouple or other flame sensing system to detect temperature changes caused by a flame being extinguished. Fourth flame sensor 119 may be disposed near or coupled to a second igniter assembly 125, discussed herein, or may be coupled to first igniter assembly 124. Although four flame sensors are shown, examples are not so limited, and additional flame sensors or fewer flame sensors may be included within the assembly 100.

A first igniter assembly 124 may be coupled to the first carrier tube 102 and may further be coupled to first flame sensor 118, second flame sensor 120, third flame sensor 122, and/or fourth flame sensor 119. As used herein, an igniter assembly refers to a module or element that is used to ignite gas flowing within apparatus 100. First igniter assembly 124 may include an assembly 126, disposed within apparatus 100, and discussed further herein.

A second igniter assembly 125 may be coupled to the second carrier tube 108 and may further be coupled to first flame sensor 118, second flame sensor 120, third flame sensor 122, and/or fourth flame sensor 119. As with first igniter assembly 124, second igniter assembly 125 may serve to ignite gas flowing within apparatus 100. In some examples, second igniter assembly 125 may not be used, in favor of using first igniter assembly 124. However, in other examples, second igniter assembly 125 may be the preferred igniter assembly, and may be used as the igniter assembly for apparatus 100.

First igniter assembly 124 may be comprised of an assembly 126 disposed within apparatus 100. FIG. 1 shows assembly 126 disposed within first carrier tube 102 towards the first input end 104; however, examples are not so limited and assembly 126 may be disposed at any point within apparatus 100. In addition, second igniter assembly 125 may be comprised of assembly 126; in such examples, assembly 126 may be disposed within second carrier tube.

In some examples, assembly 126 may be a pilot light assembly. In the case of a pilot light assembly, assembly 126 may be disposed within a carrier tube (first carrier tube 102 and/or second carrier tube 108) and may include a pilot light. As described previously, a pilot light is a flame that is established and maintains burning through one or more flame sensors, such as flame sensors 118, 119, 120, and/or 122, and assists in lighting gas flowing through the system and thus the gas-powered device. In such examples, first igniter assembly 124 and/or second igniter assembly 125 may use the pilot light to ignite the gas flowing through the system.

In other examples, assembly 126 is a direct fire assembly. A direct fire assembly refers to an assembly in which a flame is established and maintained burning through one or more flame sensors, such as flame sensors 118, 119 120, and/or 122. By maintaining the flame, gas is maintained flowing through the system, and thus through the gas powered device. As with a pilot light assembly, a direct fire assembly may be disposed within the first carrier tube 102 towards the first input end 104, within the second carrier tube 108 toward the second input end 110, or anywhere within assembly 100. As with the pilot light assembly, first igniter assembly 124 and/or second igniter assembly 125 may use the flame maintained within the direct fire assembly to ignite the gas flowing through the system. Unlike a pilot light, however, a direct fire assembly may have a greater amount of flame present; that is, a series of flames may be disposed between two electrodes and be maintained so long as each electrode senses presence of the flames.

Although apparatus 100 includes a first carrier tube 102, a second carrier tube 108, and a cross tube 114, some applications may prefer to use only the first carrier tube 102. Accordingly, second carrier tube 108 may include a plurality of closures. The second carrier tube 108 may close the second input end 110 and the second output end 112, thus preventing gas flow through the second carrier tube 108 to the gas-burning device. Similarly, first carrier tube 102 may include a plurality of closures, such that the first input end 104 and/or the first output end 106 may be closed, should an application prefer using only the second carrier tube 108. This may allow for greater utilization of the apparatus 100, as it is able to be configured to work with multiple systems.

In the foregoing detailed description of the present disclosure, reference is made to the accompanying drawings that form a part hereof, and in which are shown by way of illustration how examples of the disclosure may be practiced. These examples are described in sufficient detail to enable those of ordinary skill in the art to practice the examples of this disclosure, and it is to be understood that other examples may be utilized and that process and/or structural changes may be made without departing from the scope of the present disclosure.

The FIGURES herein follow a numbering convention in which the first digit corresponds to the drawing FIGURE number and the remaining digits identify an element or component in the drawing. Elements shown in the various FIGURES herein can be added, exchanged, and/or eliminated so as to provide a number of additional examples of the present disclosure. In addition, the proportion and relative scale of the elements provided in the figures are intended to illustrate the examples of the present disclosure and should not be taken in a limiting sense.

What is claimed is:

1. An apparatus, comprising:

a first carrier tube having a first input end and a first output end;

a second carrier tube having a second input end and a second output end and disposed substantially parallel to the first carrier tube;

a cross tube coupled to the first carrier tube and the second carrier tube and disposed substantially perpendicularly between the first carrier tube and the second carrier tube;

a plurality of burner holes disposed along the first carrier tube, the second carrier tube, and the cross tube;

a first flame sensor disposed at the first input end of the first carrier tube;

a second flame sensor disposed at the first output end of the first carrier tube;

a third flame sensor disposed at the second output end of the second carrier tube;

a fourth flame sensor disposed at the second input end of the second carrier tube; and a first igniter assembly coupled to the first carrier tube.

2. The apparatus of claim 1, further comprising a second igniter assembly coupled to the second carrier tube.

3. The apparatus of claim 1, wherein:

the first input end further comprises a first connector to couple the apparatus to a gas source; and the second input end further comprises a second connector to couple the apparatus to the gas source.

4. The apparatus of claim 1, wherein the first carrier tube includes a first closure to close the first output end.

5. The apparatus of claim 1, wherein the second carrier tube includes a second closure to close the second output end.

6. The apparatus of claim 1, further comprising a pilot light assembly disposed within a carrier tube.

7. The apparatus of claim 1, further comprising a direct fire assembly disposed within a carrier tube.

* * * * *